US009638405B2

(12) United States Patent
Hobson

(10) Patent No.: US 9,638,405 B2
(45) Date of Patent: May 2, 2017

(54) ADJUSTABLE PHOTOCONTROL MOUNTING ASSEMBLY

(71) Applicant: Cree, Inc., Durham, NC (US)

(72) Inventor: Charles O. Hobson, Waterford, WI (US)

(73) Assignee: Cree, Inc., Durham, NC (US)

( * ) Notice: Subject to any disclaimer, the term of this patent is extended or adjusted under 35 U.S.C. 154(b) by 262 days.

(21) Appl. No.: 14/209,390

(22) Filed: Mar. 13, 2014

(65) Prior Publication Data

US 2015/0260377 A1 Sep. 17, 2015

(51) Int. Cl.

| | |
|---|---|
| ***H01R 4/50*** | (2006.01) |
| ***F21V 23/04*** | (2006.01) |
| ***F21V 17/02*** | (2006.01) |

(52) U.S. Cl.

CPC ..... *F21V 23/0464* (2013.01); *F21V 17/02* (2013.01); *Y10T 29/49826* (2015.01)

(58) Field of Classification Search

CPC ..... F21V 23/0464; F21V 17/02; Y10T 29/49826; H04N 7/185; G01J 1/02; G01J 1/0271; G01J 1/04

USPC ..... 439/337

See application file for complete search history.

(56) References Cited

U.S. PATENT DOCUMENTS

| | | | |
|---|---|---|---|
| 774,250 | A | 11/1904 | Hubbell |
| 903,768 | A | 11/1908 | Platt |
| 2,941,182 | A | 6/1960 | Heller |
| 2,970,222 | A | 1/1961 | Husby et al. |
| 3,031,582 | A | 4/1962 | Benner et al. |
| 3,083,347 | A | 3/1963 | Fahey, Jr. |
| 3,123,423 | A | 3/1964 | Schmitt |
| 3,343,852 | A | 9/1967 | Blight et al. |

(Continued)

FOREIGN PATENT DOCUMENTS

| | | |
|---|---|---|
| CN | 202995464 U | 6/2013 |
| CN | 202995489 U | 6/2013 |

(Continued)

OTHER PUBLICATIONS

Hubbell brochure titled "Twist-Lock Wiring Devices and Safety Enclosures" 28 pages, Copyright 1998.

(Continued)

*Primary Examiner* — Jean F Duverne
(74) *Attorney, Agent, or Firm* — Jansson Munger McKinley & Kirby Ltd.

(57) ABSTRACT

An assembly for connecting and holding a photocontrol with respect to a light fixture. The assembly includes a support member and a photocontrol receptacle over and secured with respect to the support member. The support member is on an exterior surface of a light-fixture housing at an opening formed in the housing. The photocontrol receptacle is rotatable about the support member for angular photocontrol adjustment on the light fixture. The support member is fixed with respect to the exterior surface of the light-fixture housing. The receptacle has an engagement portion rotatably engaging the support member, thereby holding the receptacle with respect to the light-fixture housing while permitting rotation of the receptacle with respect thereto. Another aspect is a related method for connecting and holding a photocontrol with respect to a light fixture.

25 Claims, 8 Drawing Sheets

(56) References Cited

U.S. PATENT DOCUMENTS

| | | | | |
|---|---|---|---|---|
| 3,379,892 | A | 4/1968 | Neagle | |
| 3,398,391 | A | 8/1968 | Brishka | |
| 3,408,501 | A | 10/1968 | Thompson | |
| 3,710,130 | A | 1/1973 | Pate | |
| 4,477,143 | A | 10/1984 | Taylor | |
| 4,653,834 | A | 3/1987 | Norden | |
| 4,972,049 | A | 11/1990 | Muench | |
| 5,593,318 | A | 1/1997 | Bilson et al. | |
| 6,059,427 | A | 5/2000 | Wedell et al. | |
| 6,089,910 | A | 7/2000 | Suzuki et al. | |
| 6,113,424 | A | 9/2000 | Shinozaki | |
| 6,592,384 | B2 | 7/2003 | Sawayanagi | |
| 6,884,089 | B2 | 4/2005 | Obikane et al. | |
| 7,622,701 | B2 | 11/2009 | Stevens et al. | |
| 7,637,766 | B2 * | 12/2009 | Kauffman | G01J 1/02 439/337 |
| 8,038,481 | B1 | 10/2011 | Creighton et al. | |
| 8,398,435 | B2 | 3/2013 | Aurongzeb et al. | |
| 8,864,514 | B2 * | 10/2014 | Ilyes | G08C 19/00 439/337 |
| 2005/0055172 | A1 * | 3/2005 | Flaherty | G01J 1/02 702/117 |
| 2008/0067322 | A1 * | 3/2008 | Stevens | G01J 1/04 250/206.1 |
| 2009/0050785 | A1 * | 2/2009 | Flaherty | F21V 23/0442 250/205 |
| 2009/0088021 | A1 * | 4/2009 | Kauffman | G01J 1/02 439/552 |
| 2010/0252715 | A1 * | 10/2010 | Flaherty | G01J 1/02 250/206 |
| 2012/0088401 | A1 | 4/2012 | Mochizuki et al. | |
| 2013/0044444 | A1 * | 2/2013 | Creighton | G01J 1/0271 361/752 |
| 2013/0210252 | A1 * | 8/2013 | Ilyes | G08C 19/00 439/226 |
| 2015/0124100 | A1 * | 5/2015 | McRory | H04N 7/185 348/151 |

FOREIGN PATENT DOCUMENTS

| | | | |
|---|---|---|---|
| CN | 202995490 | U | 6/2013 |
| CN | 202996718 | U | 6/2013 |
| CN | 202998582 | U | 6/2013 |
| CN | 203202991 | U | 9/2013 |

OTHER PUBLICATIONS

An Internet article titled "National Electrical Manufacturers Association" retrieved from the Wikipedia.org on Feb. 24, 2014; URL: http://en.wikipedia.org/wiki/National_Electrical_Manufacturers_Association.

GE product information sheet for "Dimming Controller—Outdoor" 1 page, Copyright 2011.

GE product image for WOLC LED S 12331; retrieved from the Internet on Mar. 7, 2014, URL: http://www.gelighting.com/LightingWeb/na/images/GE-Wireless-Lighting-Control-System . . . .

GE product information sheet for The Monitor Stand-Alone Controller titled "Next-generation Control" 1 page.

* cited by examiner

ADJUSTABLE PHOTOCONTROL MOUNTING ASSEMBLY

FIELD OF THE INVENTION

This invention relates generally to apparatus for connecting and holding photocontrols with respect to light fixtures, and to angular adjustment thereof.

BACKGROUND OF THE INVENTION

In the field of lighting, light fixtures are needed in many different settings, including high fixture positions for the most efficient use of light. Light fixtures for roadways, parking lots and other large outdoor areas typically use plug twist-lock photoelectric controllers (referred to herein as "photocontrols") to automatically switch light fixtures on at dusk and off at dawn. These devices sense the intensity of the ambient light and switch the fixtures on and off accordingly. For best performance, photocontrols need to be oriented such that the cell faces in the direction of north in the northern hemisphere and south in the southern hemisphere, away from direct sunlight. It is desirable that photocell receptacles permit adjustment to the desired orientation.

For most uniformity throughout the lighting industry, electrical receptacles for receiving photoelectric controllers are mostly made according to specific requirements approved by American National Standards Institute, Inc. (ANSI). Such receptacles are typically mounted on the top of light-fixture housings and are electrically wired into the power supply for the light fixtures. A photoelectric controller is plugged into each receptacle to provide photoelectric control for the light fixture.

FIGS. 11 and 12 show an example of a common photocontrol unit 11 having three standard conductors in the form of prongs 110 which are inserted into corresponding openings 301 in the receptacle by applying downward pressure on the photocontrol casing. After the prongs are completely inserted, the controller is rotated to lock it in place. As more light fixtures use light emitting diodes (LEDs), many of such fixtures are also being configured for a dimming option which can be controlled via different methods, including wirelessly.

ANSI has recently approved a set of standards for making photocontrols and receptacles that are configured for up to four new conductors in addition to the three standard conductors. The new conductors provide electrical connections that accommodate additional control features such as dimming. As seen in FIG. 6 of ANSI C136.41-2013 standards, such new conductors may be in the form of conductive spring(s) on the photocontrol unit and corresponding conductive plate(s) on the receptacle.

After insertion in the receptacle, both types of photocontrols, i.e., the standard three-prong and the new five- or seven-prong photocontrols, should be orientated in the appropriate direction to optimize the operation of the photoelectric cell.

There have been several prior arrangements for mounting photocontrol receptacles to light fixtures and adjustment of the receptacle orientation to provide appropriate plugged-in photocontrol orientation.

In some prior arrangements, orientation adjustment is achieved by loosening screws that secure the receptacle to the light fixture, rotating the receptacle until an arrow or other indicia is aimed generally toward north, and then re-tightening the screws. Such operation requires certain disassembling of the receptacle and the challenge of not changing the desired receptacle orientation while re-tightening the screws.

Some other prior receptacles are resiliently attached to the light-fixture housing surface using a snap ring. In such arrangements, the orientation adjustment is achieved by lifting the receptacle to disengage it from the fixture housing and turning the receptacle to a desired orientation. However, lifting of the receptacle also disengages weather sealing that protect the fixture housing interior from the elements. This presents a difficulty of ensuring that the weather seal is functioning properly to prevent water from entering the housing.

Certain of the prior assemblies require significant room inside the fixture housing to accommodate mounting of the receptacle. Many recent LED light fixtures have considerably slimmer profiles than prior light fixtures that used non-LED light sources. Therefore, LED light fixtures have very limited room inside their housings.

Thus, there is a need for simple mounting assembly which takes minimal interior space and permits easy tool-less orientation while maintaining weather seals that prevent water from entering the light-fixture housing.

SUMMARY OF THE INVENTION

The present invention is an improvement in an assembly for connecting and holding a photocontrol with respect to a light fixture. The inventive assembly includes a support member and a photocontrol receptacle over and secured with respect to the support member. The support member is on an exterior surface of a light-fixture housing at an opening formed in the housing. The photocontrol receptacle is rotatable about the support member for angular photocontrol adjustment on the light fixture.

In certain embodiments, the support member has a peripheral region beyond the opening. In some of such embodiments, the receptacle has a body portion and an engagement portion extending from the body portion. The body portion supports photocontrol electrical connections. The engagement portion rotatably engages the support member, thereby holding the receptacle with respect to the light-fixture housing while permitting rotation of the receptacle with respect thereto.

The engagement portion may extend over and radially beyond the peripheral region of the support member.

The engagement portion may have a peripheral outer surface including gripping features thereon to facilitate manual rotation of the engagement portion of the receptacle about the peripheral region of the support member.

In some embodiments, the peripheral region of the support member includes a peripheral edge portion spaced from the exterior surface of the light-fixture housing. The engagement portion of the receptacle may be in snap-engagement with the peripheral edge portion.

In some of such embodiments, the peripheral edge portion of the support member is annular and unbroken and the engagement portion of the receptacle is annular and unbroken. In such embodiments, the engagement portion of the receptacle may have an inner surface defining a groove which receives the peripheral edge portion of the support member. The snap-engagement may be substantially watertight.

The peripheral edge portion of the support member and the engagement portion of the receptacle may have interfering features configured and positioned to limit rotation of the receptacle with respect to the support structure beyond 360°.

In some embodiments, the support member and the engagement portion of the receptacle are configured for non-free rotation such that photocontrol is retained in a selected angular orientation with respect to the light fixture. The support member may include an upwardly projecting wall. In some of these versions, the receptacle has a downward-facing surface in frictional engagement with the upwardly projecting wall of the support member. In some of such embodiments, the upwardly projecting wall of the support member terminates with an upper toothed edge. The downward-facing surface of the receptacle may have a toothed surface portion engaging the toothed upper edge of the support member creating resistance to unintentional rotation of the receptacle with respect to the support member.

In certain embodiments, the support member is a separate piece fixedly attached to the exterior surface of the light-fixture housing. Such embodiments may include a seal between the support member and the exterior surface of the light-fixture housing.

In certain embodiments, the engagement portion of the receptacle is a separate piece secured to the body portion of the receptacle. In such embodiments, the receptacle may include a seal between the body and the engagement portion.

In some embodiments, the support member is a separate piece fixedly attached to the exterior surface of the light-fixture housing and the engagement portion of the receptacle is a separate piece secured to the body portion of the receptacle. In such embodiments, the receptacle may include a seal between the body and the engagement portion. Such embodiments may also include a seal between the support member and the exterior surface of the light-fixture housing.

Another aspect of the present invention is a method for connecting and holding a photocontrol with respect to a light fixture. The inventive method includes the steps of providing a support member on an exterior surface of a light-fixture housing at an opening formed in the housing; positioning a photocontrol receptacle over the support member; securing the photocontrol receptacle with respect to the light-fixture housing; and rotating the secured receptacle about the support structure for angular photocontrol adjustment on the light fixture.

The method may include the further step of connecting a photocontrol to the receptacle such that the rotating step is after the connecting step.

In certain method embodiments, the support member has a peripheral region beyond the opening. In some of such embodiments, the receptacle has a body portion and an engagement portion extending from the body portion. The body portion supports photocontrol electrical connections. The engagement portion rotatably engages the support member, thereby holding the receptacle with respect to the light-fixture housing while permitting rotation of the receptacle with respect thereto.

In some embodiments, the support member is a separate piece from the light-fixture housing. In such method embodiments, the step of providing the support member includes the further step of fixedly attaching the support member to the exterior surface of the light-fixture housing. Such embodiments may also include the further step of sealing the attachment between the support member and the exterior surface of the light-fixture housing.

In some embodiments, the engagement and body portions of the receptacle are separate pieces. In such method embodiments, the step of positioning the photocontrol receptacle over the support member includes the further step of joining the body portion with the engagement portion of the receptacle.

It will be noted that the terms "over" and "under" are used in describing relative positions of certain elements of the assembly of this invention. Such terms are used with reference to part orientations in a manufacturing method used, and not necessarily with reference to gravity or to the position of a light fixture when installed for use.

In descriptions of the invention, including in the claims below, the terms "comprising," "including" and "having" (each in their various forms) and the term "with" are each to be understood as being open-ended, rather than limiting, terms.

DETAILED DESCRIPTIONS OF EXEMPLARY EMBODIMENTS

Figure 7:
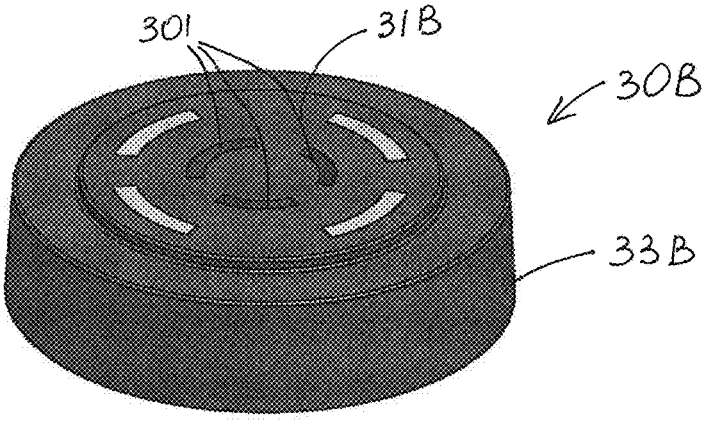
FIG. 7 is a perspective view of an alternative embodiment of the inventive photocontrol-receptacle mounting assembly with the receptacle body and engagement portions being a one-piece.
Figure 8:
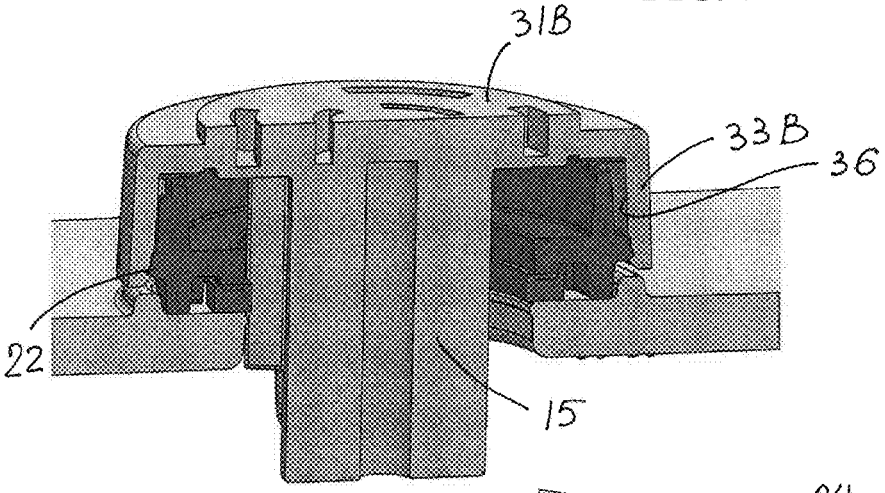
FIG. 8 is cross-sectional perspective view of the assembly of FIG. 7 taken along a vertical plane including a diameter of the receptacle.
Figure 9:
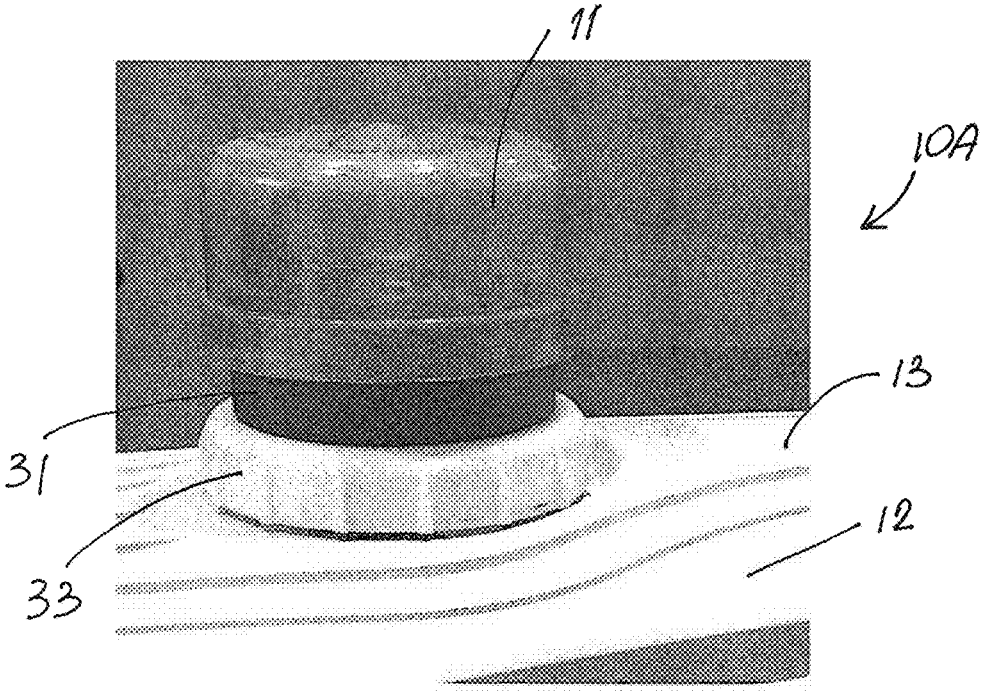
FIG. 9 is a side perspective view of the assembly of FIG. 1 with a photocontrol connected thereto.
Figure 10:
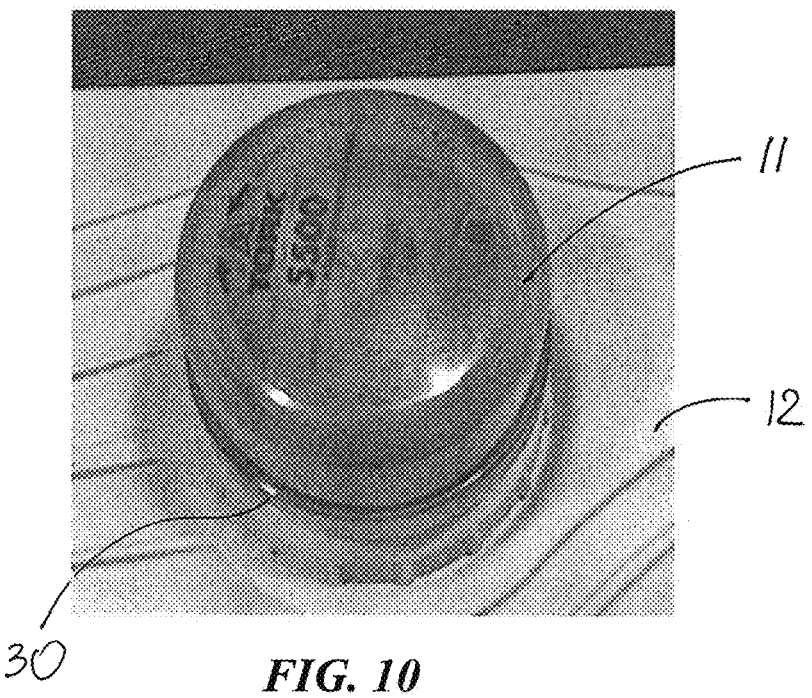
FIG. 10 is a top perspective view of the assembly of FIG. 9.
Figure 11:
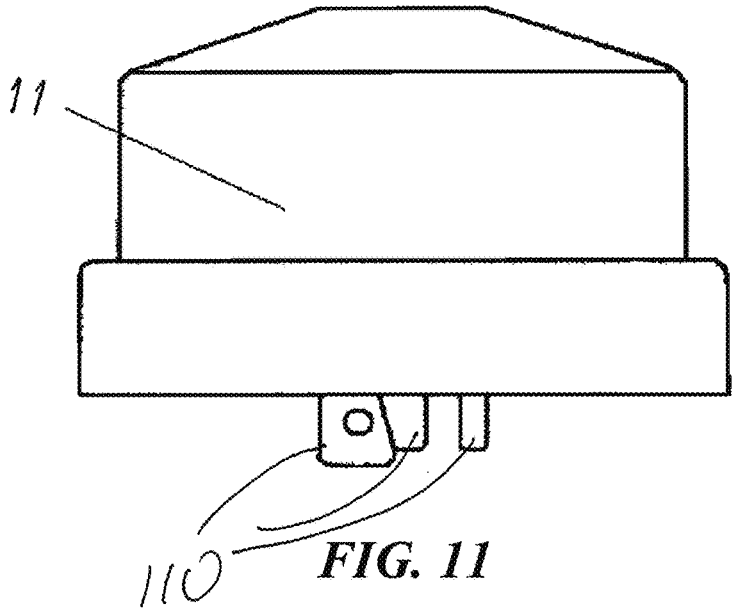
FIG. 11 is a schematic side view of an example of a three-prong photocontrol.
Figure 12:
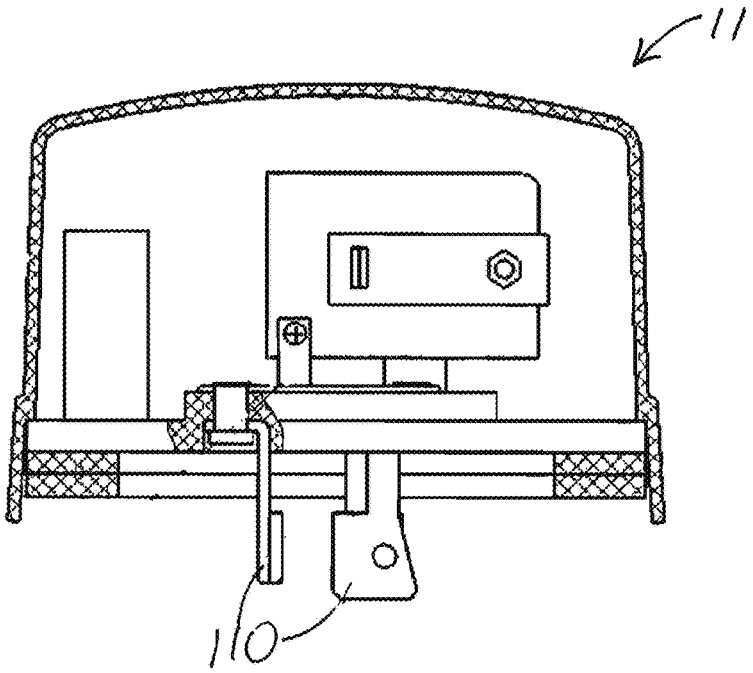
FIG. 12 is schematic cross-sectional view of the photocontrol of FIG. 11.

FIGS. 1-10 illustrate exemplary embodiments of a mounting assembly 10 for connecting and holding a photocontrol 11 with respect to a light fixture. Assembly 10 includes a support member 20 and a photocontrol receptacle 30 which is positioned over and secured with respect support member 20. FIGS. 1, 3, 5, 6 and 8 best show that support member 20 is disposed on an exterior surface 13 shown as being an upper exterior surface of a light-fixture housing 12 at an opening 14 formed in housing 12. Photocontrol receptacle 30 is rotatable about support member 20 for angular photocontrol adjustment on light fixture. FIGS. 9 and 10 illustrate that assembly 10 permits for angular orientation of photocontrol 11 together with receptacle 30, i.e., after the photocontrol has been connected to receptacle 30.

Figure 1:
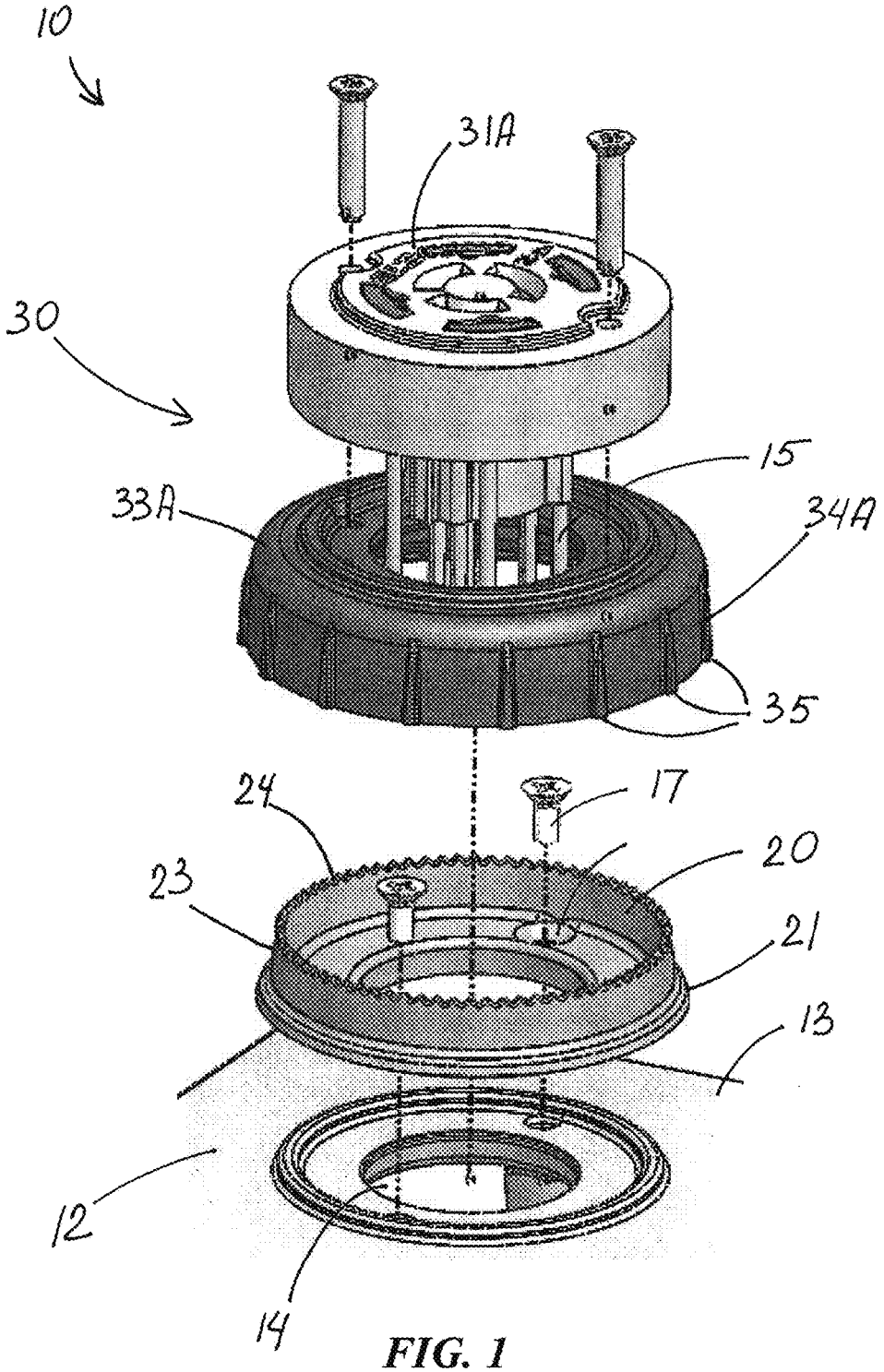
FIG. 1 is an exploded perspective view of an exemplary embodiment of the inventive photocontrol-receptacle mounting assembly.

It is best seen in FIGS. 1, 3-6, 8 and 8A that support member 20 has a peripheral region 21 beyond opening 14. FIGS. 1-3 and 5-9 best illustrate that receptacle 30 has a body portion 31 and an engagement portion 33 extending from body portion 31. As best seen in FIGS. 1 and 8, body portion 31 supports photocontrol electrical connections 15. FIGS. 1, 3, 3A, 8 and 8A also show an example of how engagement portion 33 rotatably engages support member 20. These figures and FIGS. 9-10 illustrate receptacle 30, including the photocontrol connected thereto. Receptable 30 is held by support member 20 with respect to light-fixture housing 12 while permitting rotation of receptacle 30 with respect to light-fixture housing 12.

Figure 4:
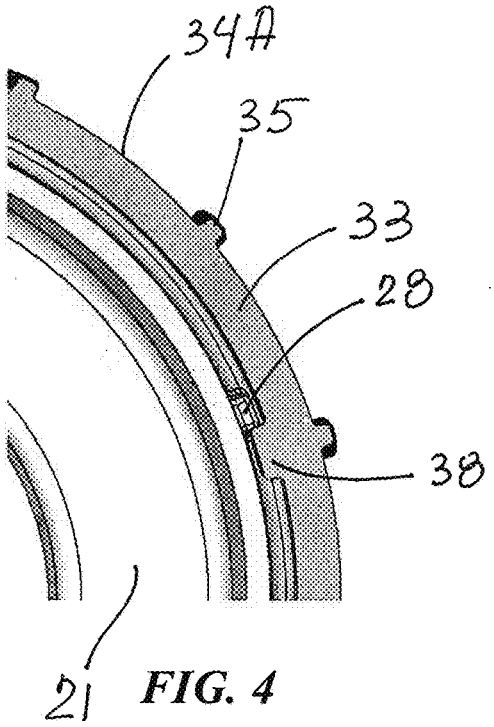
FIG. 4 is a fragmentary cross-sectional view taken along a plane of rotation of the receptacle with respect to the support structure, showing a structure limiting such rotation beyond 360°.

FIG. 4 shows engagement portion 33 of receptacle 30 having a projection 38, and peripheral edge portion 22 of support member 20 having a projection 28 positioned in the way of projection 38. Interference between projections 28 and 38 form interfering features configured and positioned to limit rotation of the receptacle about the support structure beyond 360°.

FIGS. 3-6 and 8 show that engagement portion 33 of receptacle 30 extends over and radially beyond peripheral region 21 of support member 20.

In a first embodiment shown in FIGS. 1-6, 9 and 10, engagement portion 33A has a peripheral outer surface 34A which includes gripping features 35 thereon to facilitate manual rotation of engagement portion 33A of receptacle 30A about peripheral region 21A of support member 20A.

Figure 8A:
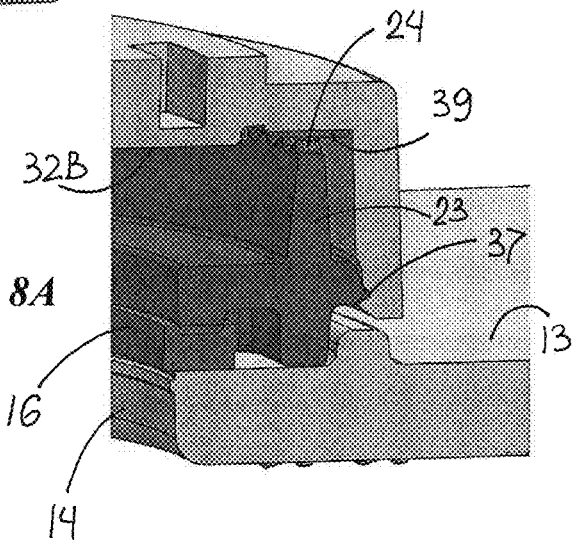
FIG. 8A is an enlarged fragmentary view showing exemplary engagement between a support member and a receptacle, as seen in FIG. 8.

FIGS. 3, 5, 6 and 8 show that peripheral region 21 of support member 20 includes a peripheral edge portion 22 spaced from exterior surface 13 of light-fixture housing 12. FIGS. 3A and 8A best show engagement portion 33 of receptacle 30 in snap-engagement with peripheral edge portion 22 of support member 20.

FIG. 1 best shows peripheral edge portion 22 of support member 20 as annular and unbroken. It should be understood that the peripheral edge portion of the support member may have an interrupted configuration. In some of such embodiments, the support member may include several spaced-apart pieces that together form such peripheral edge portion.

Figure 2:
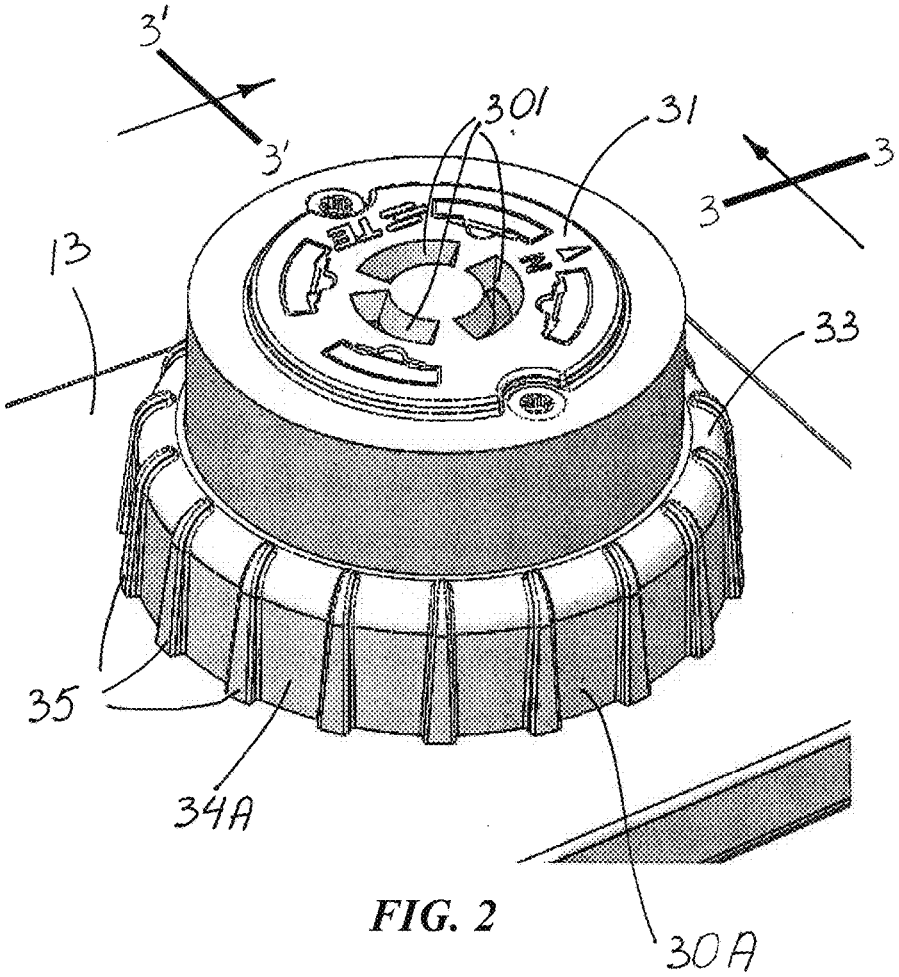
FIG. 2 is a perspective view of the assembly of FIG. 1.

FIGS. 2 and 7 best show engagement portion 33 of receptacle 30 also as annular and unbroken. In some versions, however, the engagement portion of the receptacle may include one or more open spaces which create an interrupted engagement-portion configuration. In some of such versions, the engagement portion may include a plurality of spaced fingers engaging the peripheral edge portion of the support member.

It is best seen in FIGS. 3A and 8A that engagement portion 33 of receptacle 30 has an inner surface 36 defining a groove 37 which receives peripheral edge portion 22 of support member 20. The snap-engagement of annular and unbroken groove 37 with annular and unbroken peripheral edge portion 22 may be substantially water-tight.

FIGS. 3A, 5, 6, 8 and 8A best show that the engagement of groove 37 with peripheral edge portion 22 is substantially tight for frictional engagement therebetween to minimize an unintended rotation of receptacle 30 with respect to support member 20. It is best seen in FIG. 1 that support member 20 also includes an upwardly projecting wall 23 terminating with a toothed upper edge 24.

FIGS. 5, 6, 8 and 8A also show receptacle 30 having a downward-facing surface 32 which has a toothed surface portion 39 engaging toothed upper edge 24 of support member 20. Such engagement between toothed upper edge 24 and toothed surface portion 39 creates resistance to rotational movement of receptacle 30 with respect to support member 20 such that photocontrol 11 is retained in a selected angular orientation with respect to the light fixture. When adjusting angular orientation of receptacle 30 with or without photocontrol 11, the user must apply sufficient force to move toothed surface portion 39 of receptacle 30 past the teeth of toothed upper edge 24 of the support member 20. It is further seen in FIGS. 5, 6 and 8 that toothed upper edge 24 and toothed surface portion 39 are configured and relatively positioned to have a sufficient clearance therebetween to permit manual forced rotation while resisting photocontrol displacement via rotation due to vibration or other causes.

Figure 3:
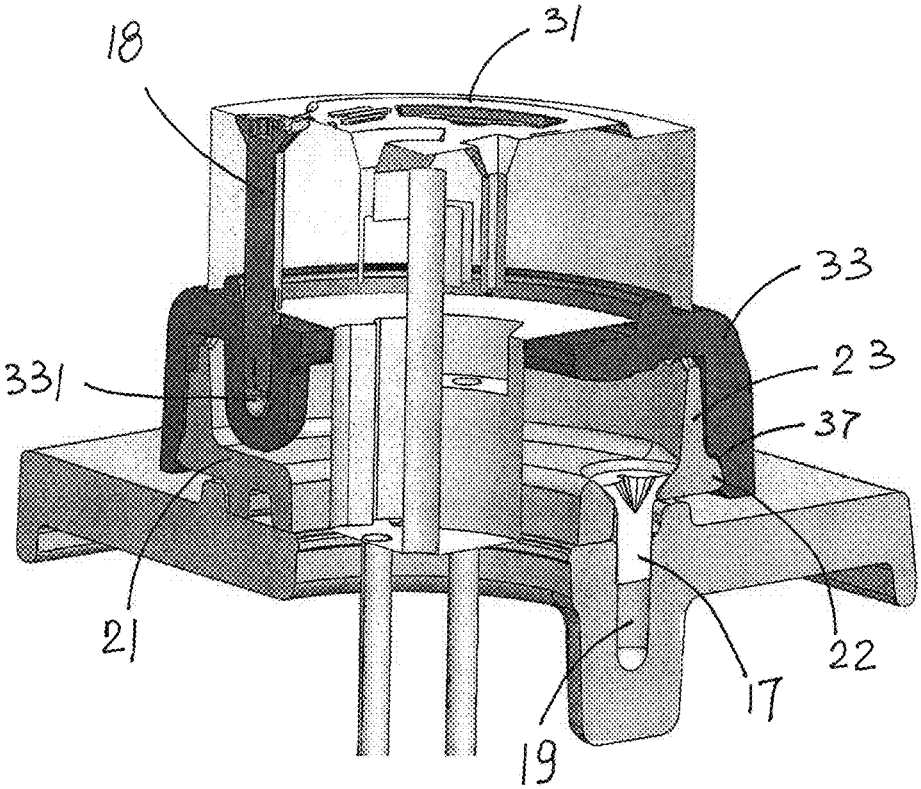
FIG. 3 is a cross-sectional perspective view of the assembly of FIG. 1 taken along two transverse planes 3-3 and 3'-3' seen in FIG. 2.
Figure 3A:
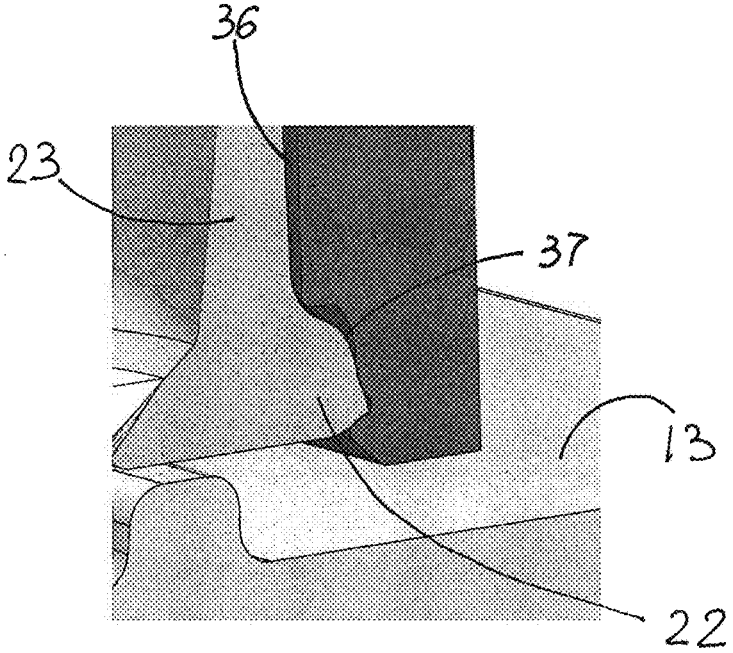
FIG. 3A is an enlarged fragmentary view showing exemplary engagement between a support member and a receptacle, as seen in FIG. 3.
Figure 5:
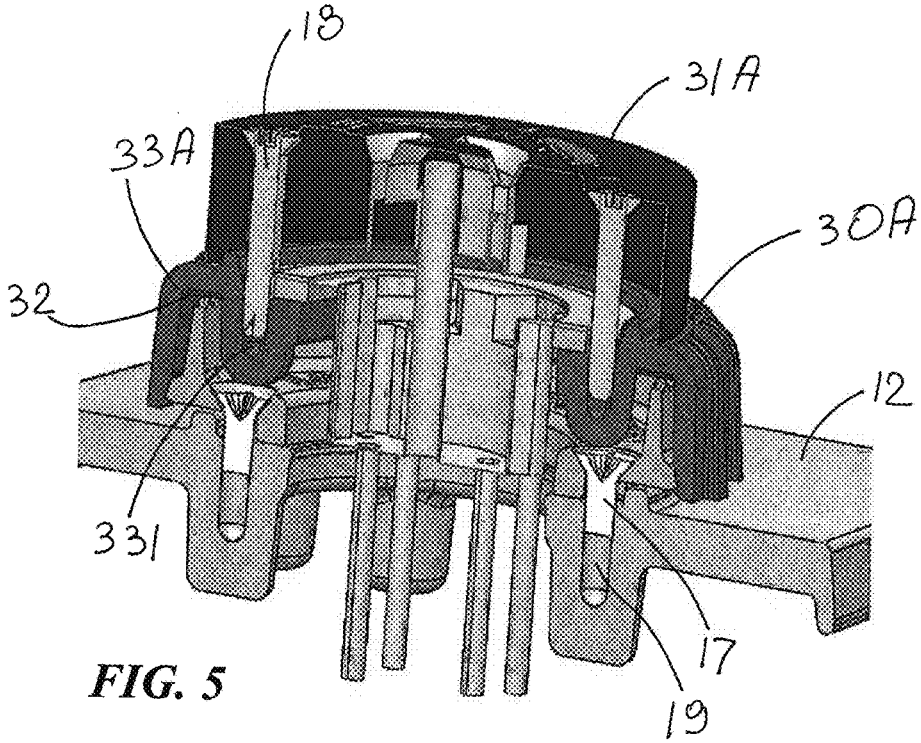
FIG. 5 is another cross-sectional perspective view of the assembly of FIG. 1 taken along a vertical plane including a diameter of the receptacle and extending through the fasteners seen in FIG. 2.
Figure 6:
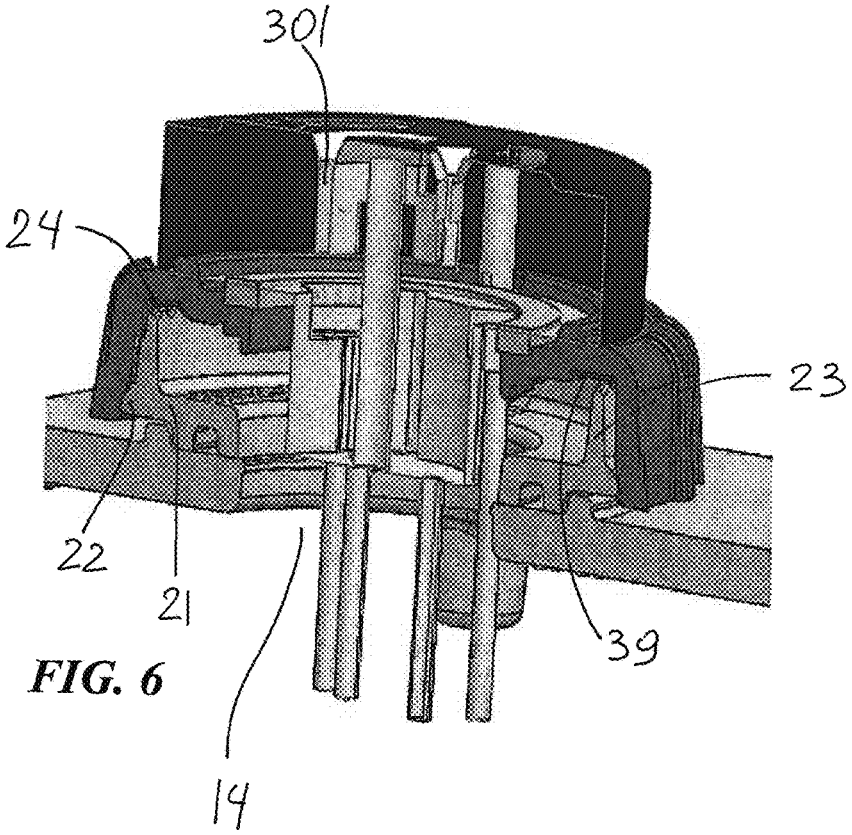
FIG. 6 is another cross-sectional perspective view of the assembly of FIG. 1 taken along a vertical plane including a diameter of the receptacle and transverse the section plane of FIG. 5.

In the illustrated embodiments, support member 20 is a separate piece fixedly attached to exterior surface 13 of light-fixture housing 12, as seen at least in FIGS. 1, 3, 5 illustrating a first embodiment of the invention and FIGS. 8 and 8A illustrating a second embodiment of the invention. FIGS. 1, 3 and 5 show attachment of support member 20 to light-fixture housing 12 with fasteners 17 which extend through fastening apertures 25 in support member 20 and into fastener-receiving cavities 19 formed in an outer wall of fixture housing 12.

FIGS. 8 and 8A show a sealing gasket 16 positioned between support member 20B and exterior surface 13 of light-fixture housing 12.

In the first embodiment illustrated in FIGS. 1-6, 9 and 10, engagement portion 33A of receptacle 30A is a separate piece secured to body portion 31A of receptacle 30. In such embodiments, receptacle 30A may include a seal in the form of a gasket or other suitable manner between body 31A and engagement portion 33A.

FIGS. 1, 3 and 5 also show joining body portion 31A of receptacle 30 with engagement portion 33A by inserting fasteners 18 through body portion 31A into cavities 331 formed in engagement portion 33A of receptacle 30.

In the second embodiment illustrated in FIGS. 7, 8 and 8A, receptacle body portion 31B and engagement portion 33B are formed as one-piece in rotational engagement with support member 20B.

FIGS. 1-10 illustrate also a method for connecting and holding a photocontrol with respect to a light fixture. FIG. 1 best shows the steps of providing support member 20 on exterior surface 13 of light-fixture housing 12 at opening 14 formed in housing 12. The step of positioning photocontrol receptacle 30 over support member 20 is best shown in FIGS. 1, 3-6 and 8. FIGS. 3, 3A, 8 and 8A show how photocontrol receptacle 30 is secured with respect to light-fixture housing 12. FIGS. 2-4 illustrate how secured receptacle 30 is rotated about support structure 20 for angular photocontrol adjustment on a light fixture.

The inventive method may also include the further step of connecting photocontrol 11 to receptacle 30 such that the rotating step may be after the connecting step, as seen in FIGS. 9 and 10.

FIG. 1 best shows the step in which support member 20 separate from light-fixture housing 12 is fixedly attached to exterior surface 13 of light-fixture housing 12. The step of sealing the attachment between support member 20 and exterior surface 13 of light-fixture housing 12 is best illustrated in FIGS. 8 and 8A.

FIG. 1 also best shows the step of joining body portion 31A with separate engagement portion 33A of receptacle 30A.

While the principles of the invention have been shown and described in connection with specific embodiments, it is to be understood that such embodiments are by way of example and are not limiting.

The invention claimed is:

1. An assembly for connecting and holding a photocontrol with respect to a light fixture, the assembly comprising:

a support member on an exterior surface of a light-fixture housing at an opening into the housing; and a receptacle with slots for insertion of photocontrol conductors, the receptacle being secured with respect to the support member such that the support member is between a light-fixture exterior surface about the opening and the receptacle which is rotatable about the support member for angular photocontrol adjustment on the light fixture.

2. The assembly of claim 1 wherein:

the support member has a peripheral region beyond the opening; and the receptacle has (a) a body portion defining the slots and supporting electrical connections for the photocontrol and (b) an engagement portion extending from the body portion and rotatably engaging the support member, thereby holding the receptacle with respect to the light-fixture housing while permitting rotation of the receptacle with respect thereto.

3. The assembly of claim 2 wherein the engagement portion extends over and radially beyond the peripheral region of the support member.

4. The assembly of claim 2 wherein the engagement portion has a peripheral outer surface including gripping features thereon to facilitate manual rotation of the engagement portion of the receptacle about the peripheral region of the support member.

5. An assembly for connecting and holding a photocontrol with respect to a light fixture, the assembly comprising:

a support member on an exterior surface of a light-fixture housing at an opening formed in the housing, the support member having a peripheral region beyond the opening, the peripheral region of the support member including a peripheral edge portion spaced from the exterior surface of the light-fixture housing; and a photocontrol receptacle over and secured with respect to the support member and rotatable thereabout for angular photocontrol adjustment on the light fixture, the receptacle having (a) a body portion supporting photocontrol electrical connections and (b) an engagement portion extending from the body portion and being in snap-engagement with the peripheral edge portion of the support member, thereby holding the receptacle with respect to the light-fixture housing while permitting rotation of the receptacle with respect thereto.

6. The assembly of claim 5 wherein:

the peripheral edge portion of the support member is annular and unbroken; and the engagement portion of the receptacle is annular and unbroken.

7. The assembly of claim 6 wherein the engagement portion of the receptacle has an inner surface defining a groove which receives the peripheral edge portion of the support member.

8. The assembly of claim 7 wherein the snap-engagement is substantially water-tight.

9. The assembly of claim 5 wherein the peripheral edge portion of the support member and the engagement portion of the receptacle have interfering features configured and positioned to limit rotation of the receptacle with respect to the support structure beyond 360°.

10. The assembly of claim 5 wherein the support member and the engagement portion of the receptacle are configured for non-free rotation, thereby keeping the photocontrol in a selected angular orientation with respect to the light fixture.

11. The assembly of claim 10 wherein:

the support member includes an upwardly projecting wall; and the receptacle has a downward-facing surface in frictional engagement with the upwardly projecting wall of the support member.

12. The assembly of claim 11 wherein:

the upwardly projecting wall of the support member terminates with an upper toothed edge; and the downward-facing surface of the receptacle has a toothed surface portion engaging the toothed upper edge of the support member creating resistance to unintentional rotation of the receptacle with respect to the support member.

13. The assembly of claim 5 wherein the support member is a separate piece fixedly attached to the exterior surface of the light-fixture housing.

14. The assembly of claim 13 further including a seal between the support member and the exterior surface of the light-fixture housing.

15. The assembly of claim 5 wherein the engagement portion of the receptacle is a separate piece secured to the body portion of the receptacle.

16. The assembly of claim 1 wherein the support member is a separate piece fixedly attached to the exterior surface of the light-fixture housing.

17. The assembly of claim 16 further including a seal between the support member and the exterior surface of the light-fixture housing.

18. A method for connecting and holding a photocontrol with respect to a light fixture, the method comprising:

providing a support member on an exterior surface of a light-fixture housing at an opening into the housing;

positioning over the support member a receptacle with slots for insertion of photocontrol conductors;

securing the receptacle with respect to the support member such that the support member is between the receptacle and the light-fixture exterior surface about the opening;

connecting the photocontrol to the receptacle by inserting the photocontrol conductors into the slots of the receptacle; and rotating the secured receptacle about the support structure for angular photocontrol adjustment on the light fixture.

19. The method of claim 18 wherein the rotating step is after the connecting step.

20. The method of claim 18 wherein:

the support member has a peripheral region beyond the opening; and the receptacle has (a) a body portion defining the slots and supporting electrical connections for the photocontrol and (b) an engagement portion extending from the body portion and rotatably engaging the support member, thereby holding the receptacle with respect to the light-fixture housing while permitting rotation of the receptacle with respect thereto.

21. The method of claim 20 wherein:

the support member is a separate piece from the light-fixture housing; and the step of providing the support member includes the further step of fixedly attaching the support member to the exterior surface of the light-fixture housing.

22. The method of claim 21 comprising the further step of sealing the attachment between the support member and the exterior surface of the light-fixture housing.

23. The method of claim 18 wherein:

the engagement and body portions of the receptacle are separate pieces; and the step of positioning the photocontrol receptacle over the support member includes the further step of joining the body portion with the engagement portion of the receptacle.

24. The method of claim 23 wherein:

the support member is a separate piece from the light-fixture housing; and the step of providing the support member includes the further step of fixedly attaching the support member to the exterior surface of the light-fixture housing.

25. The method of claim 24 comprising the further step of sealing the attachment between the support member and the exterior surface of the light-fixture housing.

* * * * *